United States Patent [19]

Sexton

[11] Patent Number: 5,068,933

[45] Date of Patent: Dec. 3, 1991

[54] AIR COMFORT PILLOW

[76] Inventor: Eugene D. Sexton, 4434 S. Highway 67 N., Sycamore, Ohio 44882

[21] Appl. No.: 610,016

[22] Filed: Nov. 7, 1990

[51] Int. Cl.[5] ..... A47C 20/02

[52] U.S. Cl. ..... 5/441; 5/442; 5/453

[58] Field of Search ..... 5/423, 434, 437, 440, 5/441, 442, 454, 453, 462, 491

[56] References Cited

U.S. PATENT DOCUMENTS

| | | | |
|---|---|---|---|
| 795,108 | 7/1905 | Doellinger | 5/441 |
| 2,826,767 | 3/1958 | Edwards | 5/441 |
| 3,112,502 | 12/1963 | Forsberg | 5/454 |
| 3,392,412 | 6/1968 | Aymar | 5/453 X |
| 4,141,585 | 2/1979 | Blackman | 5/423 X |
| 4,807,313 | 2/1989 | Ryder et al. | 5/453 X |
| 4,829,614 | 5/1989 | Harper . | |
| 4,897,890 | 2/1990 | Walker | 5/453 |
| 4,979,249 | 12/1990 | Meade, II | 5/454 X |
| 4,984,315 | 1/1991 | Ortman et al. | 5/441 X |
| 5,007,410 | 4/1991 | Delaney | 5/462 X |

*Primary Examiner*—Michael F. Trettel
*Assistant Examiner*—Michael J. Milano

[57] ABSTRACT

A sleeping pillow having an inflatable air bag and a built-in air compressor and air exhaust control mechanism, such that the softness or hardness of the pillow can be regulated to meet individual requirements. The air compressor is powered by dry cell batteries that are located within a housing for the compressor. The air compressor housing is located within a pocket at one end of the pillow.

7 Claims, 1 Drawing Sheet

AIR COMFORT PILLOW

BACKGROUND OF THE INVENTION

This invention relates to a sleeping pillow, especially a pillow that includes an inflatable air bag disposed within an annular cushioner sleeve. The pillow of the present invention comprises a battery-operated air compressor located within a pocket at one end of the pillow. A manual control means is associated with the compressor, whereby the compressor can be energized to pressurize the air bag within the pillow. To provide a further control on the relative hardness or softness of the pillow there is provided a manually-operated means for exhausting pressurized air from the bag. The manual control system is such that the person can raise or lower the bag pressure while the person's head is resting on the pillow surface. The person can thus experience the effect of a pillow that is too hard or too soft, and change the condition of the pillow until it corresponds with that person's particular requirements.

U.S. Pat. No. 4,829,614 to J. Harper shows a pillow that includes a main body formed out of foam rubber, and four generally cylindrical air bags insertable into cylindrical chambers that extend transversely within the foam rubber body. The patentee indicates that the four air bags can be inflated to an infinite number of pressures for controlling the firmness of the support provided by the main foam body.

It is believed that the use of four air bags, as disclosed in the Harper patent, would tend to provide an uneveness in the support action, with areas of the foam body aligned with the air bags being relatively firm, and with other areas being relatively soft.

The individual air bags in the Harper pillow are equipped with air valves that can be accessed after a zipper structure on the pillow case has been moved to an open position. The individual valves are recessed into the chambers that contain the associated air bags. Therefore access to the valves for filling the bags (or exhausting air from the bags) is not easily accomplished.

It is not entirely clear what type of air pressure source would be used with the Harper pillow to supply pressurized air to the air bags. In any event the air pressure source (manual foot pump or motor-operated compressor) would have to be connected to each air valve and later disconnected from each air valve. The process would be somewhat time-consuming. Also, the process of adding or removing pressurized air would presumably not be carried out while the person's head was resting on the pillow surface. The person very likely would not have a personal sense of the pillow feel on his/her head while going through the process of varying the pressure within the four air bags.

My proposed pillow is constructed to have a self-contained air compressor and manual control unit, such that the person can vary the air bag pressure while his/her head is resting on the pillow surface. The person can thus experience the effect of an increased air bag pressure or a decreased air bag pressure, and at the same time make adjustments based on the feel of the pillow, rather than on a guess as to what would be most comfortable.

THE DRAWINGS

DESCRIPTION OF A PREFERRED EMBODIMENT OF THE INVENTION

The drawings show a sleeping pillow that comprises an elongated air bag 11 having a longitudinal axis 13 and a transverse axis 15. A cushioner sleeve 17 of resilient foam rubber extends longitudinally along and around air bag 11, with the inner surface of the sleeve in pressure contact with the outer side surface of the bag. When the bag is pressurized the bag acts as a resilient deformable support for sleeve 17. The firmness, or softness, of the support action is determined primarily by the air pressure existing within the bag.

Figure 1:
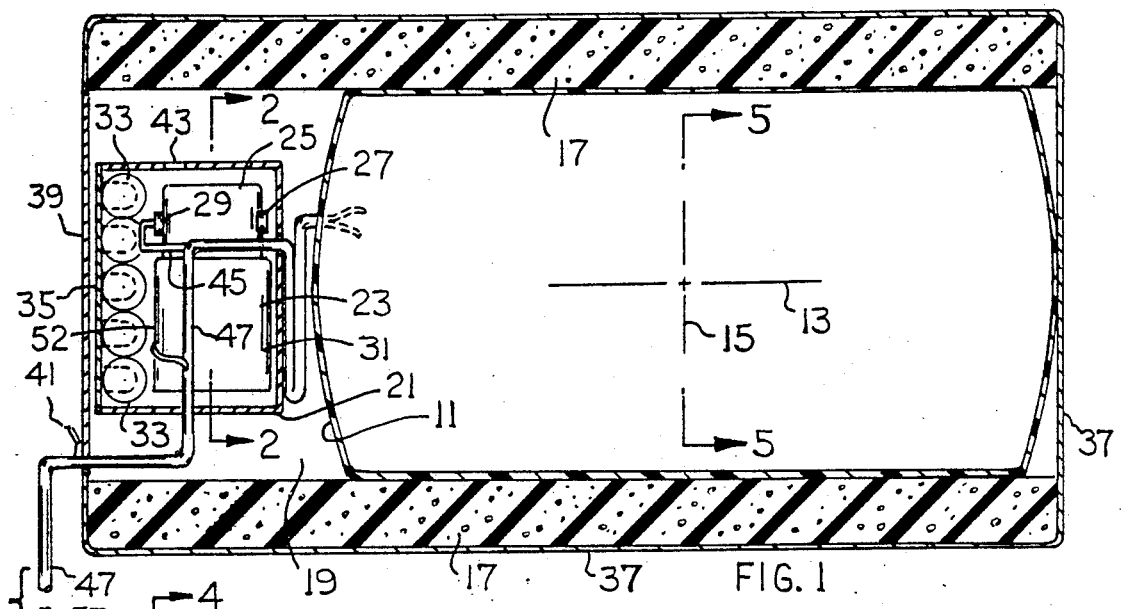
FIG. 1 is a sectional view taken through a pillow embodying this invention.

As seen in FIG. 1, sleeve 17 is longer than the longitudinal dimension of bag 11, such that a pocket 19 is formed within the sleeve adjacent the left end of the air bag. Removably disposed within pocket 19 is a small rigid housing 21 that contains an air compressor 23. The air compressor comprises a mechanical air compressor component 25 having an air inlet 27 and an air outlet 29. Component 25 can be a conventional rotary vane mechanism. Drivably connected to air compressor 25 is an electric motor 31. Dry cell batteries 33 supply electric energy to the motor, whereby the motor rotates the vane type compressor 25 to pump air from inlet 27 through outlet 29. Batteries 33 can be supported on a swing-down door 35 for housing 21, so that when the door is opened access may be had to the batteries for battery replacement purposes. A cloth pillow case 37 envelopes cushioner sleeve 17 to normally conceal housing 21. A zipper 39, having a slide fastener 41, extends across an end of pillow case 37 to permit access to housing 21 and its swing-down door 35. The zipper is shown in its closed position.

Figure 3:
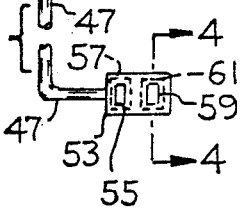
FIG. 3 is a fragmentary sectional view of a structural detail used in the FIG. 1 pillow.
Figure 3:
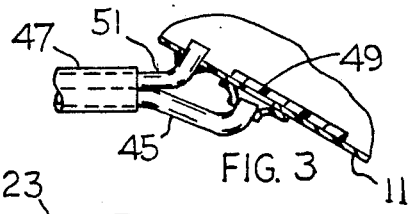

Housing 21 can have one or more air openings 43. Also, the end wall of pillow case 37 can have one or more openings therein, whereby atmosphere air can be supplied to compressor inlet 27. Pressurized air can flow from outlet 29 through a flexible tube 45 that has a portion thereof extending within a hollow flexible cable 47. FIG. 3 shows the free end of tube 45 connected to air bag 11, such that the pressurized air can flow from the tube across a flap-type check valve 49 into the bag interior space. A second flexible tube 51 extends from the air bag into and along cable 47 for exhausting air from the air bag (when a valve at the remote end of tube 51 is in an opened condition.)

Cable 47 houses two tubes 45 and 51, as well as the control wiring 52 for motor 31. The cable extends from the air bag through housing 21 to an external hand-held control box 53. At the point where the cable passes through the pillow case wall there is an opening that is closed by zipper fastener 41. When the slide fastener is moved to its opened position the housing 21 can be physically removed from pocket 19 without disconnecting tubes 45 and 51 from the air bag; some slack is built into the cable and associated tubes.

Figure 4:
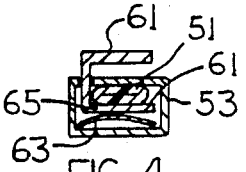
FIG. 4 is a view taken on line 4—4 in FIG. 1.
Figure 2:
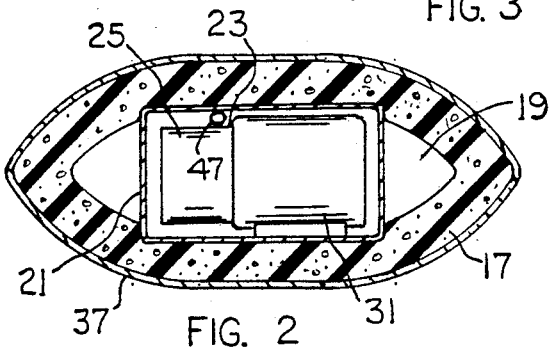
FIG. 2 is a transverse sectional view taken on line 2—2 in FIG. 1.
Figure 5:
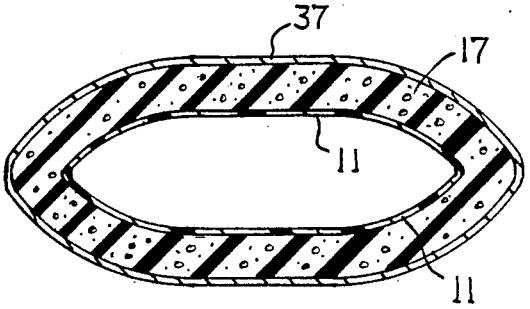
FIG. 5 is a sectional view taken on line 5—5 in FIG. 1.

Control box 53 contains a push button 55 for operating an electric switch 57 and a second push button 59 for operating an air valve 61. Switch 57 is connected to control wiring 52, such that manual depression of button 55 enables the switch to operatively connect batteries 33 to motor 31, thereby enabling pressurized air to flow through tube 45 into the air bag. FIG. 4 shows an operating air valve construction, wherein a leaf spring 63 normally biases a plate 65 against tube 51 to prevent air escapage from the tube. When button 59 is depressed plate 65 is moved to permit tube 51 to expand, to form an air escape opening; air is thereby exhausted from bag 11 through tube 51.

The control box can be held in a person's hand while the person's head is resting on the pillow surface. Selective depression of buttons 55 and 59 enables the person to vary the air bag pressure to fit his/her individual desires. When both buttons are released the bag pressure is maintained at whatever pressure has then been established.

I claim:

1. A sleeping pillow comprising an air-inflatible bag having a longitudinal axis and a transverse axis; an annular cushioner sleeve extending longitudinally along said bag in encircling relation thereto; said cushioner sleeve being longer than the longitudinal dimension of the bag whereby a pocket is formed within the sleeve adjacent one end of the bag; a pillow case enveloping said cushioner sleeve; a compressed air source located within said pocket in pneumatic connection with the bag; and manual means for controlling the compressed air source and air exhaust means, to thereby control bag pressure; said compressed air source comprising a mechanical air compressor that includes a compressor component and an electric drive motor connected thereto within said pocket.

2. The pillow of claim 1, and further comprising a housing removably located within said pocket, said mechanical air compressor being disposed within said housing.

3. The pillow of claim 2, and further comprising drycell battery means within said housing for supplying electric energy to said motor.

4. The pillow claim 3 wherein said manual control means comprises a hand-held control box located outside said pocket, a manually operated electric switch within the box for controlling the motor, and a manually-operated valve within the box for controlling the air exhaust means.

5. The pillow of claim 4 and further comprising a hollow flexible cable extending from said air bag through said housing to said control box; an air supply tube extending from said compressor component through said cable to said air bag; and an air exhaust tube extending from said air bag through the cable to the control box.

6. The pillow of claim 5, and further comprising a zipper means extending along the pillow case in registry with the pocket for access to said compressor housing.

7. The pillow of claim 6, wherein said annular cushioner sleeve is formed of a resilient foam material.

* * * * *